US008217583B2

(12) United States Patent
Wang et al.

(10) Patent No.: US 8,217,583 B2
(45) Date of Patent: Jul. 10, 2012

(54) GAS-DISCHARGE LAMP CONTROLLER UTILIZING A NOVEL REHEATING FREQUENCY GENERATION MECHANISM

(75) Inventors: Yen-Ping Wang, Taipei (TW); Ko-Ming Lin, Tainan (TW)

(73) Assignee: Grenergy Opto, Inc., Hsin-Chu (TW)

( * ) Notice: Subject to any disclaimer, the term of this patent is extended or adjusted under 35 U.S.C. 154(b) by 219 days.

(21) Appl. No.: 12/840,776

(22) Filed: Jul. 21, 2010

(65) Prior Publication Data

US 2012/0019159 A1 Jan. 26, 2012

(51) Int. Cl.
*H05B 37/02* (2006.01)

(52) U.S. Cl. ..... 315/224; 315/246; 315/307; 315/209 R

(58) Field of Classification Search ..... 315/101, 315/94, 209 R, 219, 224, 200 R, 246, 247, 315/291, 229, 307–311
See application file for complete search history.

(56) References Cited

U.S. PATENT DOCUMENTS

| | | | | |
|---|---|---|---|---|
| 4,988,920 | A * | 1/1991 | Hoeksma | 315/101 |
| 6,316,886 | B1 * | 11/2001 | Luger et al. | 315/307 |
| 6,696,791 | B2 * | 2/2004 | Raiser et al. | 315/94 |
| 6,788,001 | B2 * | 9/2004 | Lechner | 315/94 |
| 7,812,612 | B2 * | 10/2010 | Feldtkeller et al. | 324/414 |
| 7,839,093 | B2 * | 11/2010 | Kastle et al. | 315/224 |
| 2011/0285322 | A1 * | 11/2011 | Wang et al. | 315/307 |

* cited by examiner

*Primary Examiner* — Vibol Tan
(74) *Attorney, Agent, or Firm* — Muncy, Geissler, Olds & Lowe, PLLC

(57) ABSTRACT

A gas-discharge lamp controller utilizing a novel preheating frequency generation mechanism, including: a resistance sensing means, used to generate a sensed voltage when coupled to an external series resistor-capacitor network, the external series resistor-capacitor network being biased between a first supply voltage and a reference ground; a sample and hold circuit, used to generate a sampled voltage of the sensed voltage under the control of a latch signal; and a mapping circuit, used to generate a control voltage according to a function of the sampled voltage.

10 Claims, 3 Drawing Sheets

GAS-DISCHARGE LAMP CONTROLLER UTILIZING A NOVEL REHEATING FREQUENCY GENERATION MECHANISM

BACKGROUND OF THE INVENTION

1. Field of the Invention

The present invention relates to a gas-discharge lamp controller, and more particularly to a gas-discharge lamp controller capable of adaptively generating a preheating frequency.

2. Description of the Related Art

In supplying power to gas-discharge lamps, electronic ballasts are widely adopted to keep the lamp current stable.

To increase the lifetime of gas-discharge lamps, the lighting process of the electronic ballasts should start with a preheating phase to pre heat the lamps, enter an ignition phase after the preheating phase to ignite the lamps, and then settle to a steady phase. Of the three phases, the preheating phase is required to have a preheating frequency, which varies with the characteristics of the lamps, to facilitate the ignition of the lamps and thereby prolong the lamps' lifetime.

A prior art solution for generating the preheating frequency utilizes a fixed DC voltage in the preheating phase as a control voltage for an oscillator which generates an oscillation frequency corresponding to the control voltage. Please refer to FIG. 1, which shows a block diagram of part of a ballast circuit, including a prior art gas-discharge lamp controller and some external passive components. As can be seen in FIG. 1, the gas-discharge lamp controller 100, coupled with a capacitor 105 and a series connection of resistor 106 and capacitor 107, includes an oscillator 101, a switch 102, a comparator 103, and a current source 104.

The oscillator 101, usually implemented with an astable vibrator, is used to generate a saw-tooth signal $V_{SAW}$ of which the oscillation period is determined by a control voltage $V_C$ and the RC time constant of the resistor 106 and capacitor 107. The lower/higher the voltage of the control voltage $V_C$ is, the shorter/longer the oscillation period of the saw-tooth signal $V_{SAW}$ will be.

The switch 102 has a control input end coupled to a preheating time end signal $V_{PHE}$, two input ends coupled to a first voltage $V_{H1}$ and a second voltage $V_{H2}$ respectively, and an output end for providing the control voltage $V_C$. When the preheating time end signal $V_{PHE}$ is at a low level, $V_C=V_{H1}$; when the preheating time end signal $V_{PHE}$ is at a high level, $V_C=V_{H2}$. The voltage of the first voltage $V_{H1}$ is set to a value to make the oscillator 101 generate a desired preheating frequency of the preheating phase. The second voltage $V_{H2}$ is used for the ignition phase and the steady phase.

The comparator 103, the current source 104, and the capacitor 105 are used to generate the preheating time end signal $V_{PHE}$, wherein the current source 104 has a small current and is used to charge the capacitor 105 to generate a slowly increasing voltage $V_{PHT}$. The comparator 103 is used to compare the slowly increasing voltage $V_{PHT}$ with a reference voltage $V_{REF}$ to generate the preheating time end signal $V_{PHE}$. As the slowly increasing voltage $V_{PHT}$ reaches the reference voltage $V_{REF}$, the preheating time end signal $V_{PHE}$ will change state from low to high to indicate the end of the preheating phase.

As such, each gas-discharge lamp controller 100 can generate a specific preheating frequency corresponding to a specific value of the first voltage $V_{H1}$. However, if more than one preheating frequency, for example four different preheating frequencies is needed, then four different models of gas-discharge lamp controllers—corresponding to four different values of the first voltage $V_{H1}$—will have to be prepared. This can cause inconvenience in manufacturing process and products management as well.

One prior art solution to this problem is to add an extra pin for generating the first voltage $V_{H1}$. However, this will increase the chip size and the board area, and therefore the cost.

In view of the disadvantages of the prior art design, the present invention proposes a novel topology of a gas-discharge lamp controller, capable of adaptively generating a preheating frequency with no extra pin added.

SUMMARY OF THE INVENTION

One objective of the present invention is to disclose a gas-discharge lamp controller utilizing a novel preheating frequency generation mechanism with no extra pin added, capable of adaptively generating a preheating frequency.

Another objective of the present invention is to disclose a gas-discharge lamp controller utilizing a novel preheating frequency generation mechanism with no extra pin added, which makes use of the resistance of an external RC network—the external RC network being used for determining the oscillation frequency of the steady phase—to determine the preheating frequency.

Still another objective of the present invention is to provide a gas-discharge lamp controller utilizing a novel preheating frequency generation mechanism with no extra pin added, which determines the preheating frequency by detecting a voltage caused by the resistor of the external RC network during a start-up period.

To achieve the foregoing objectives, the present invention provides a gas-discharge lamp controller utilizing a novel preheating frequency generation mechanism, the gas-discharge lamp controller comprising a resistance sensing means, a sample and hold circuit, a mapping circuit, an oscillator, a first comparator, a switch, and a second comparator.

The resistance sensing means is used to generate a sensed voltage when coupled to an external series resistor-capacitor network, which is biased between a first supply voltage and a reference ground.

The sample and hold circuit is used to provide a sampled voltage of the sensed voltage under the control of a latch signal.

The mapping circuit is used to generate a control voltage according to a function of the sampled voltage.

The oscillator has a first control end and a second control end. The oscillation frequency of the oscillator is determined according to the voltage at the first control end and the time constant of the external series resistor-capacitor network when the external series resistor-capacitor network is coupled to the second control end. The first control end is coupled to the control voltage when the gas-discharge lamp controller is in a preheating phase.

The first comparator is used to generate a switch signal according to a voltage comparison of a second supply voltage and a UVLO turn-on voltage, wherein the second supply voltage is proportional to the first supply voltage.

The switch has a switch control end, an input end, a first output end, and a second output end, wherein the switch control end is coupled to the switch signal; the input end is coupled to the external series resistor-capacitor network; the first output end is coupled to the resistance sensing means; and the second output end is coupled to the second control end of the oscillator.

The second comparator is used to generate the latch signal according to a voltage comparison of the second supply voltage and a threshold voltage, wherein the threshold voltage is lower than the UVLO turn-on voltage.

To make it easier for our examiner to understand the objective of the invention, its structure, innovative features, and performance, we use a preferred embodiment together with the accompanying drawings for the detailed description of the invention.

DETAILED DESCRIPTION OF THE PREFERRED EMBODIMENTS

The present invention will be described in more detail hereinafter with reference to the accompanying drawings that show the preferred embodiment of the invention.

Figure 1:
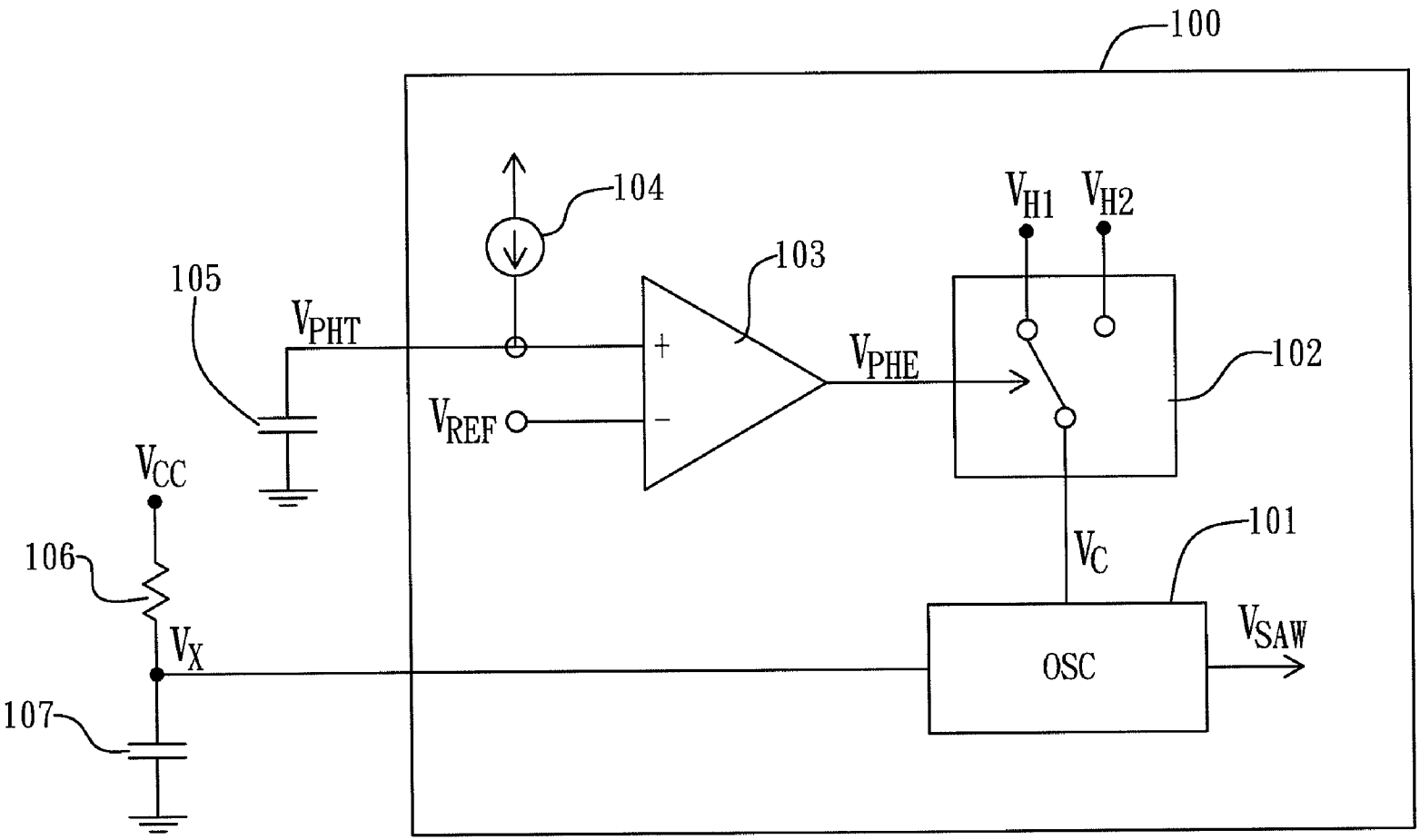
FIG. 1 (PRIOR ART)
FIG. 1 is a block diagram of part of a ballast circuit, including a prior art gas-discharge lamp controller.
Figure 2:
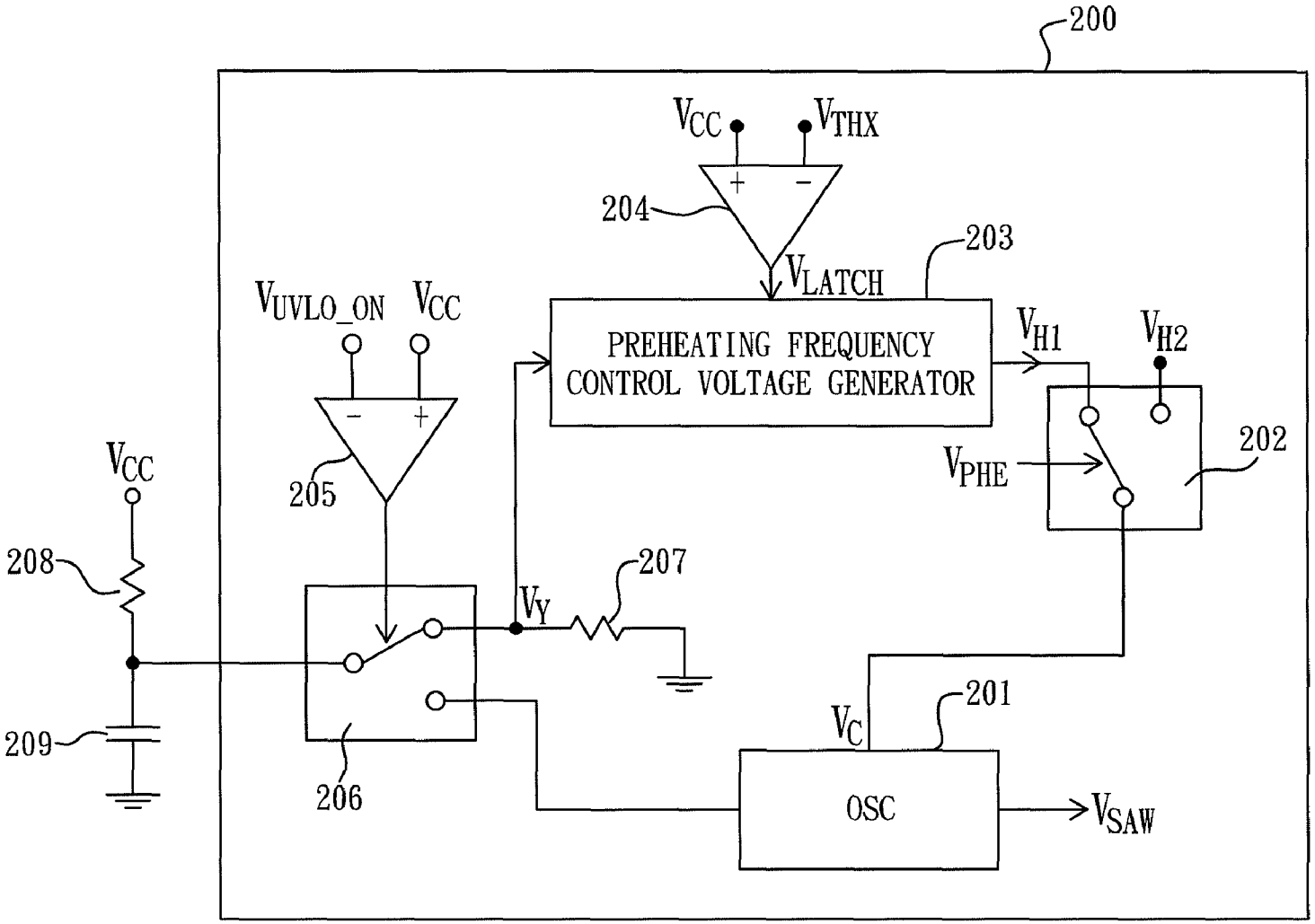
FIG. 2 is a block diagram of part of a ballast circuit, including a gas-discharge lamp controller according to a preferred embodiment of the present invention.

Please refer to FIG. 2, which shows a block diagram of part of a ballast circuit, including a gas-discharge lamp controller 200 according to a preferred embodiment of the present invention, an external resistor 208, and an external capacitor 209. As shown in FIG. 2, the gas-discharge lamp controller 200, coupled with a series connection of the resistor 208 and the capacitor 209—the series connection being biased between a supply voltage $V_{CC}$ and a reference ground, includes an oscillator 201, a switch 202, a preheating frequency control voltage generator 203, comparators 204-205, a switch 206, and an internal resistor 207.

The oscillator 201 is used to generate a saw-tooth signal $V_{SAW}$, of which the oscillation period is determined by a control voltage $V_C$ at a first control end, and the time constant of a series resistor-capacitor network coupled to a second control end. The oscillator 201 is preferably but not limited to an astable vibrator. The oscillator 201 uses a high threshold voltage, provided by the control voltage $V_C$, to determine the period of the saw-tooth signal $V_{SAW}$—each time the saw-tooth signal $V_{SAW}$ reaches the high threshold voltage, the oscillator 201 will pull down the saw-tooth signal $V_{SAW}$ to a reference ground, so the higher/lower the high threshold voltage, the longer/shorter the period.

The switch 202 has a control input end coupled to a preheating time end signal $V_{PHE}$—indicating the end of a preheating time, two input ends coupled to a first voltage $V_{H1}$ and a second voltage $V_{H2}$ respectively, and an output end for providing the control voltage $V_C$. When the preheating time end signal $V_{PHE}$ is at a low level, $V_C=V_{H1}$; when the preheating time end signal $V_{PHE}$ is at a high level, $V_C=V_{H2}$. The voltage of the first voltage $V_{H1}$ is set to a value to make the oscillator 201 generate a desired preheating frequency of the preheating phase. The second voltage $V_{H2}$ is used for the ignition phase and the steady phase.

Figure 3:
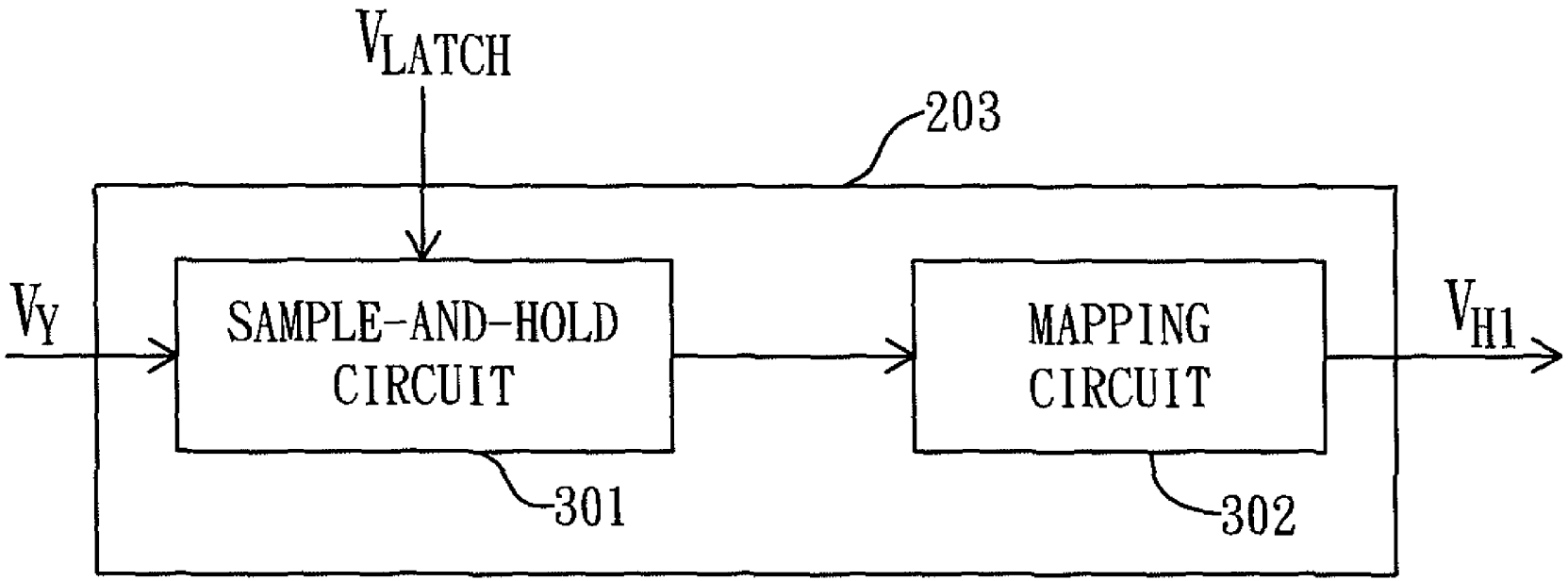
FIG. 3 is a block diagram of a preferred embodiment of the preheating frequency control voltage generator of the gas-discharge lamp controller in FIG. 2.

The preheating frequency control voltage generator 203 is used for storing a sampled voltage of a sensed voltage $V_Y$ at the rising edge of a latch signal $V_{LATCH}$, and generating the first voltage $V_{H1}$ according to a function of the sampled voltage, wherein the mapping of the function can be one-to-one—like $V_{H1}=\alpha V_Y$, wherein $\alpha$ is a constant, or multiple-to-one—like $V_{H1}=V_1$ when $a<V_Y\leqq V_{H1}=V_2$ when $b<V_Y\leqq c$; and $V_{H1}=V_3$ when $c<V_Y\leqq d$, and the implementation of the function can be accomplished by an analog circuit or by a mixed mode circuit. Please refer to FIG. 3, which shows a preferred embodiment of the preheating frequency control voltage generator 203. As can be seen in FIG. 3, the preheating frequency control voltage generator 203 includes a sample-and-hold circuit 301 and a mapping circuit 302. The sample-and-hold circuit 301 is used to hold a sampled voltage of the sensed voltage $V_Y$ at the rising edge of the latch signal $V_{LATCH}$. The mapping circuit 302 is used to generate the first voltage $V_{H1}$ according to a mapping function of the sampled voltage, wherein the mapping function can be implemented with an analog arithmetic operation circuit—for example a multiplier, or with a mixed mode waveform generation circuit—for example a look-up table based waveform generation circuit. As these circuits are well known to those having ordinary skill in the art, they will not be addressed here.

The comparator 204 is used to generate the latch signal $V_{LATCH}$ by comparing the supply voltage $V_{CC}$ with a threshold voltage $V_{THX}$. After an AC power is switched on, the level of the supply voltage $V_{CC}$ will be increasing from a low voltage, and when it reaches the threshold voltage $V_{THX}$, the latch signal $V_{LATCH}$ will change state from low to high, and therefore generate a rising edge.

The comparator 205 and the switch 206 are used as a multiplexing means to couple the series connection of the resistor 208 and the capacitor 209 either to the internal resistor 207 or to the oscillator 201. The comparator 205 is used to generate a switch signal by comparing the supply voltage $V_{CC}$ with an UVLO (Under Voltage Lock Out) turn-on voltage $V_{UVLO_ON}$, wherein $V_{UVLO_ON}$ is higher than the threshold voltage $V_{THX}$. After an AC power is switched on, the level of the supply voltage $V_{CC}$ will be increasing from a low voltage, and when it reaches $V_{UVLO_ON}$, the switch signal will change state from low to high. Although both the comparator 204 and the comparator 205 use the supply voltage $V_{CC}$ as positive input signal, it is to be known that a second supply voltage which is proportional to the supply voltage $V_{CC}$ can be used instead.

The switch 206 has a control input end coupled to the switch signal, an input end coupled to the series connection of the resistor 208 and the capacitor 209, and two output ends coupled to the internal resistor 207 and the oscillator 201 respectively. When the switch signal is at a low level, the input end is coupled to the internal resistor 207; when the switch signal is at a high level, the input end is coupled to the oscillator 201.

The internal resistor 207 is used as a resistance sensing means to generate the sensed voltage $V_Y$ ($=V_{CC}\times$the resistance of the resistor 207/(the resistance of the resistor 207+the resistance of the resistor 208)) when the series connection of the resistor 208 and the capacitor 209 is coupled with the internal resistor 207.

The operation of the circuit in FIG. 2 is described as follows:

After the AC power is switched on, the level of the supply voltage $V_{CC}$ will be increasing from a low voltage, and when the supply voltage $V_{CC}$ reaches the threshold voltage $V_{THX}$, the latch signal $V_{LATCH}$ will change state from low to high to latch the sensed voltage $V_Y$, and the first voltage $V_{H1}$ will be generated according to the mapping function. When the supply voltage $V_{CC}$ reaches $V_{UVLO_ON}$ some time later, the switch signal of the comparator 205 will change state from low to high, causing the switch 206 to change input-output connection, and thereby couple the series connection of the resistor 208 and the capacitor 209 to the oscillator 201 to generate the saw-tooth signal $V_{SAW}$.

When it is in the preheating phase, the preheating time end signal $V_{PHE}$ for controlling the switch 202 will be at a low level, causing $V_C=V_{H1}$, and the oscillation period of the saw-tooth signal $V_{SAW}$ of the oscillator 201 will be determined according to $V_{H1}$. As $V_{H1}$ is generated according to $V_Y$, and $V_Y$ is a divided voltage of $V_{CC}$ resulted by the resistor 208 and the internal resistor 207, a desired preheating frequency can be attained by selecting a corresponding resistance of the resistor 208. That is, the preheating frequency of the present invention can be programmed by the resistance of the resistor 208, and no extra pin is needed in implementing this function.

In conclusion, the present invention proposes a gas-discharge lamp controller utilizing a novel preheating frequency generation mechanism, capable of generating a preheating frequency corresponding to the resistance of an external resistor—the external resistor being in series connection with an external capacitor to form an RC circuit, which is originally used for generating an oscillation frequency for the steady phase. As such, same gas-discharge lamp controller of the present invention can be used to implement different models of electronic ballasts just by using different resistance values of the resistor of the external RC circuit. Furthermore, as the external resistor needed in determining the preheating frequency is not an extra component, no extra pin is needed. Therefore the present invention does conquer the disadvantages of the prior art design.

While the invention has been described by way of examples and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures. For example, the internal resistor 207 can be replaced with a transistor or a current source.

In summation of the above description, the present invention herein enhances the performance than the conventional structure and further complies with the patent application requirements and is submitted to the Patent and Trademark Office for review and granting of the commensurate patent rights.

What is claimed is:

1. A gas-discharge lamp controller utilizing a novel preheating frequency generation mechanism, comprising:

a resistance sensing means, used to generate a sensed voltage when coupled to an external series resistor-capacitor network, said external series resistor-capacitor network being biased between a first supply voltage and a reference ground;

a sample and hold circuit, used to generate a sampled voltage of said sensed voltage under the control of a latch signal; and a mapping circuit, used to generate a control voltage according to a function of said sampled voltage.

2. The gas-discharge lamp controller utilizing a novel preheating frequency generation mechanism as claim 1, further comprising an oscillator, having a first control end and a second control end, wherein the oscillation frequency of said oscillator is determined according to the voltage at said first control end and the time constant of said external series resistor-capacitor network when said external series resistor-capacitor network is coupled to said second control end, and wherein said first control end is coupled to said control voltage when said gas-discharge lamp controller is in a preheating phase.

3. The gas-discharge lamp controller utilizing a novel preheating frequency generation mechanism as claim 2, further comprising a multiplexing means, which comprises:

a first comparator, used to generate a switch signal according to a voltage comparison of a second supply voltage and a UVLO turn-on voltage, said second supply voltage being proportional to said first supply voltage; and a switch, having a switch control end, an input end, a first output end, and a second output end, wherein said switch control end is coupled to said switch signal; said input end is coupled to said external series resistor-capacitor network; said first output end is coupled to said resistance sensing means; and said second output end is coupled to said second control end of said oscillator.

4. The gas-discharge lamp controller utilizing a novel preheating frequency control mechanism as claim 3, further comprising a second comparator, used to generate said latch signal according to a voltage comparison of said second supply voltage and a threshold voltage, wherein said threshold voltage is lower than said UVLO turn-on voltage.

5. The gas-discharge lamp controller utilizing a novel preheating frequency control mechanism as claim 1, wherein said mapping circuit comprises a multiplier.

6. The gas-discharge lamp controller utilizing a novel preheating frequency control mechanism as claim 1, wherein said mapping circuit comprises a look-up table based waveform generation circuit.

7. The gas-discharge lamp controller utilizing a novel preheating frequency control mechanism as claim 1, wherein said resistance sensing means comprises a resistor.

8. The gas-discharge lamp controller utilizing a novel preheating frequency control mechanism as claim 1, wherein said resistance sensing means comprises a current source.

9. The gas-discharge lamp controller utilizing a novel preheating frequency control mechanism as claim 2, wherein said oscillator comprises an astable vibrator.

10. A gas-discharge lamp controller utilizing a novel preheating frequency generation mechanism, comprising:

a resistance sensing means, used to generate a sensed voltage when coupled to an external series resistor-capacitor network, said external series resistor-capacitor network being biased between a first supply voltage and a reference ground;

a sample and hold circuit, used to generate a sampled voltage of said sensed voltage under the control of a latch signal;

a mapping circuit, used to generate a control voltage according to a function of said sampled voltage;

an oscillator, having a first control end and a second control end, wherein the oscillation frequency of said oscillator is determined according to the voltage at said first control end and the time constant of said external series resistor-capacitor network when said external series resistor-capacitor network is coupled to said second control end, and wherein said first control end is coupled to said control voltage when said gas-discharge lamp controller is in a preheating phase;

a first comparator, used to generate a switch signal according to a voltage comparison of a second supply voltage and a UVLO turn-on voltage, said second supply voltage being proportional to said first supply voltage;

a switch, having a switch control end, an input end, a first output end, and a second output end, wherein said switch control end is coupled to said switch signal, said input end is coupled to said external series resistor-capacitor network, said first output end is coupled to said resistance sensing means, and said second output end is coupled to said second control end of said oscillator; and a second comparator, used to generate said latch signal according to a voltage comparison of said second supply voltage and a threshold voltage, wherein said threshold voltage is lower than said UVLO turn-on voltage.

* * * * *